United States Patent [19]

Beebe

[11] Patent Number: 4,560,193

[45] Date of Patent: Dec. 24, 1985

[54] CARRYING DEVICE FOR TRANSPORTING A CYLINDRICAL TANK

[76] Inventor: Randall Beebe, 1206 - 5th Ave., Picayune, Miss. 39466

[21] Appl. No.: 610,524

[22] Filed: May 15, 1984

[51] Int. Cl.[4] ..... B65D 63/18

[52] U.S. Cl. ..... 294/31.2; 294/103.1; 294/119.2

[58] Field of Search ..... 294/15, 16, 27 R, 28, 294/31.2, 103 R, 104, 113, 137, 164, 165, 167, 169, 90, 92

[56] References Cited

U.S. PATENT DOCUMENTS

| | | | |
|---|---|---|---|
| 436,967 | 9/1890 | Crawford | 294/103 R X |
| 659,100 | 10/1900 | Piercy | 294/113 |
| 744,813 | 11/1903 | Stewart | 294/113 |
| 1,475,146 | 11/1923 | Septer | 294/92 |
| 1,672,311 | 6/1928 | Ermatinger | 294/31.2 X |
| 2,145,066 | 1/1939 | Wright | 294/103 R |
| 2,218,845 | 10/1940 | Kiggins | 294/16 |
| 2,634,157 | 4/1953 | Haddock | 294/104 |
| 2,917,338 | 12/1959 | Blue | 294/31.2 |
| 4,463,978 | 8/1984 | Mountain et al. | 294/31.2 |

*Primary Examiner*—Johnny D. Cherry
*Attorney, Agent, or Firm*—Keaty & Keaty

[57] ABSTRACT

A carrying device for transporting a cylindrical tank is disclosed which is especially suited for being quickly attached and detached from oxygen and acetylene tanks. A circular collar having an inner diameter greater than the outer diameter of the cylindrical tanks is provided. Three gripping teeth are disposed equidistantly from each other on the inner face of the collar, two of the teeth being stationary and the third being movable from a first position in frictionally gripping engagement with the exterior of the tank around which the collar is placed to a second position not in frictionally gripping engagement therewith. The third gripping tooth is reciprocated between the first and second position by means of a pivotal handle mounted adjacent a projection on the movable tooth, the pivoting of the handle abutting the projection on the tooth to move it forward. The handle itself is a pistol grip handle having an elongated opening through which the fingers of the hand may be placed and a hook receiving, circular opening through which the handle may be attached to a crane.

5 Claims, 5 Drawing Figures

CARRYING DEVICE FOR TRANSPORTING A CYLINDRICAL TANK

BACKGROUND OF THE INVENTION

1. Field of the Invention

This invention concerns carrying devices for cylindrical tanks, such as oxygen or acetylene tanks. This invention especially concerns devices suitable for being quickly secured to and removed from a tank to facilitate loading and unloading of the tanks on ships, trucks and the like.

2. Description of the Prior Art

A device for conveniently and safely transporting the bulky cylindrical tanks in which oxygen and acetylene are stored has long been sought. For example, U.S. Pat. No. 4,116,374 discloses a strap for placement around a cylindrical tank, with two generally opposed handles being carried by the strap by which the tank can be manually transported. U.S. Pat. No. 3,921,872 discloses a carrying case for placement around the tank having a handle with a hand slot contained therein.

The idea of placing a collar around tanks or drums has also been disclosed in U.S. Pat. Nos. 3,817,435, 4,345,789 and 4,009,898.

All of these prior art structures have, however, suffered from serious drawbacks. None of them are readily suited for use in transporting a number of tanks. For example, U.S. Pat. No. 4,345,789 is suited for being secured to an acetylene tank which is carried from place to place by a welder. It is in no fashion suitable for attachment to a number of tanks because of its cumbersome means of attachment to the tank.

Another serious drawback of each of the prior art structures is that none of them are suitable for being selectively carried by hand or by a hook attached to a crane. This restriction found in the prior art is especially serious since both mechanical and manual transportation of the bulky tanks is often required at different stages during the transportation of the tanks.

Accordingly, it is an object of the present invention to provide a carrying device which is adapted for being quickly and conveniently placed on and taken off of bulky cylindrical tanks.

It is a further object of the invention to provide such a device which grips the tank to prevent accidental dislodgement thereof and consequent injury to handling personnel.

It is an even further object of the invention to provide a collar having a plurality of gripping teeth on the interior of the collar placed around a tank, one of these gripping teeth being selectively movable from a first position in which it is in frictionally gripping engagement with the cylindrical tank to a second position in which it is not in frictional engagement with the tank.

Another object of the invention is to provide a handle pivotally mounted on the collar in such a way that the pivoting of the handle advances the movable gripping tooth into frictionally gripping engagement with the cylindrical tank.

It is still a further object of the invention to provide a handle readily adapted for being manually carried or attached to a hook and frame.

SUMMARY OF THE INVENTION

The foregoing objects have been achieved by providing a carrying device for transporting a cylindrical tank which is comprised of a substantially circular collar having an inner face and an outer face, the diameter of the circular opening defined by the inner face being greater than the outer diameter of the cylindrical tank about which the collar is placed. A pair of opposing, substantially parallel flanges are mounted on the outside face of the collar on either side of an aperture through the collar, and each of the flanges is provided with opposing and substantially parallel limit slots. Three frictional gripping teeth are disposed substantially equidistantly from each other on the inner face of the collar, two of the teeth being stationary and a third being provided with a means for moving it from a first position in frictionally gripping engagement with the exterior of the tank around which the collar is placed to a second position not in frictionally gripping engagement therewith.

The means for moving the movable gripping tooth is a projection on the tooth which protrudes through the aperture in the collar between the flanges. The projection carries a limit pin which ride within the opposing limit slots in the flanges. A pistol grip handle is pivotally mounted between the flanges adjacent the projection on the movable tooth so that pivoting of the handle inclines the handle against the limit pin and moves the tooth inwardly towards the tank.

The pistol grip handle is provided with an elongated slot in the gripping portion of the handle through which the fingers of the hand may be placed to manually carry the tank. A circular opening is provided in an enlarged portion of the handle through which a hook may be placed to attach the device to a crane for transportation of the cylindrical tank.

The carrying device can quickly be attached to a cylindrical tank by placing the collar around the tank and pivoting the handle towards the tank to move the movable tooth into frictionally gripping engagement with the exterior of the tank. The handle can then be manually grasped through the slot in the pistol grip handle or attached to a crane through the hook receiving hole. After the tank is transported, the tank is placed on the ground and the upward pressure on the pivotal handle is thereby relieved, which permits the movable tooth to move away from the exterior of the tank and allow the collar to be expeditiously removed from that tank.

DETAILED DESCRIPTION OF THE PREFERRED EMBODIMENT

Figure 1:
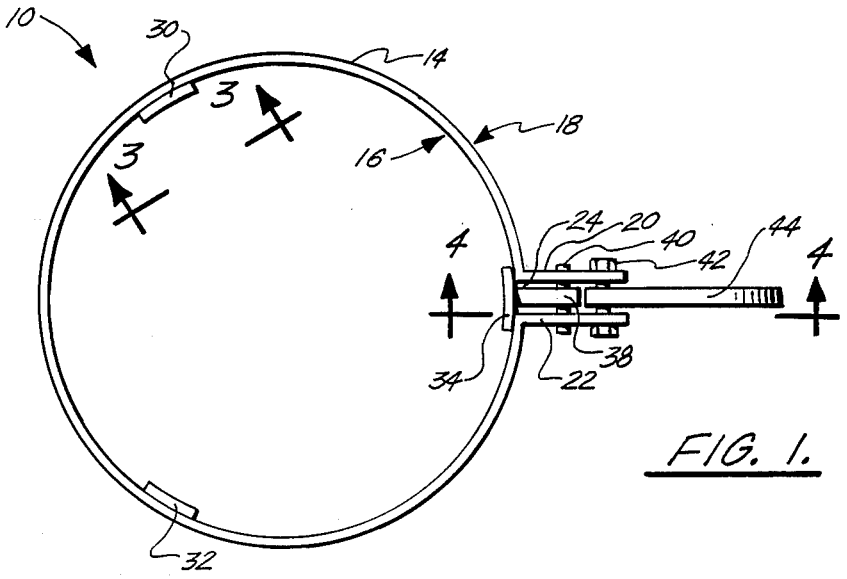
FIG. 1 is a top plan view of the carrying device of the present invention.
Figure 2:
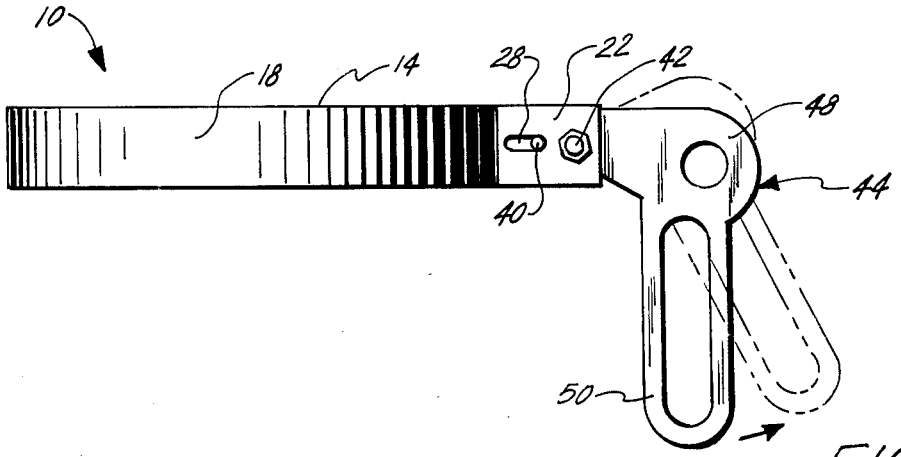
FIG. 2 is a side view of the device shown in FIG. 1, the position of the handle after pivoting being shown in phantom.
Figure 3:
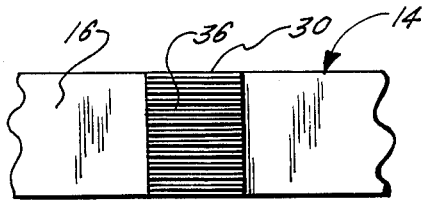
FIG. 3 is a view of a frictional gripping tooth on the inner face of the collar taken along line 3—3 in FIG. 1, the position of the pivotal handle after pivoting being shown in phantom.
Figure 4:
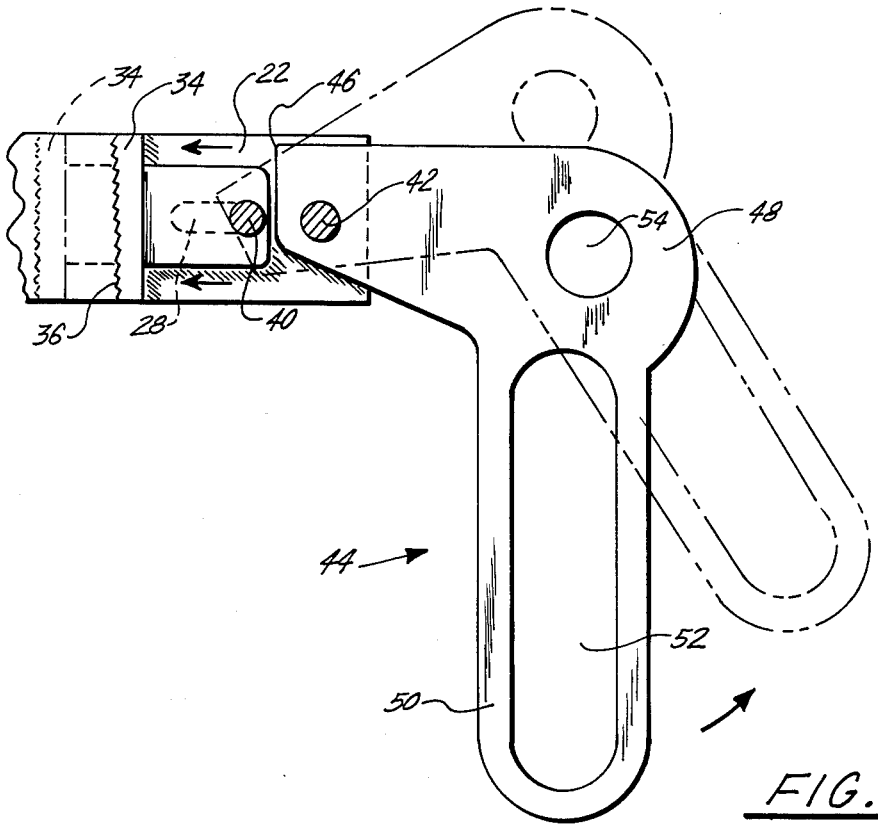
FIG. 4 is a view taken along lines 4—4 in FIG. 1.
Figure 5:
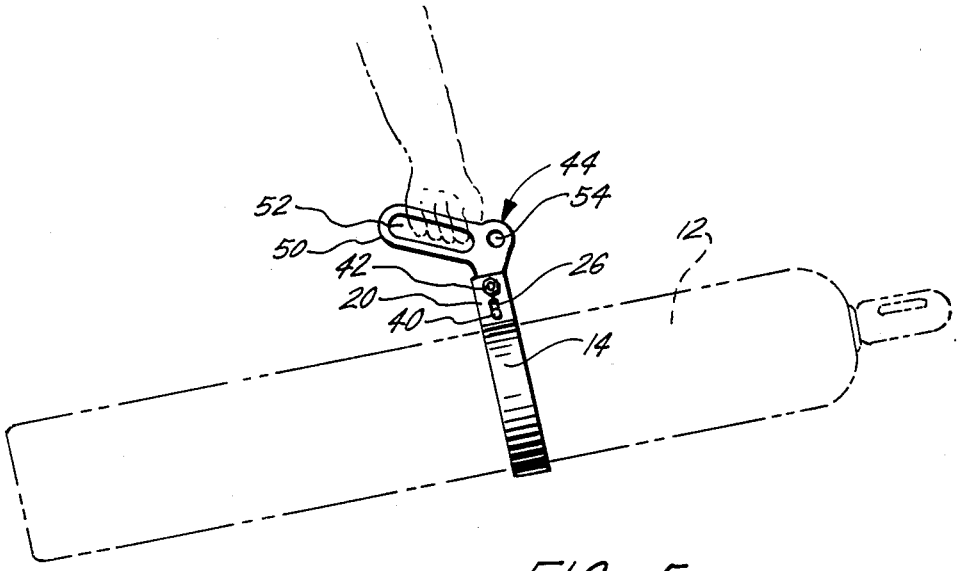
FIG. 5 is a view of the carrying device in use, the fingers of the hand being placed through the elongated slot in the pistol grip handle, the handle being pivoted to advance the frictional gripping tooth into frictional engagement with the cylindrical tank.

A carrying device 10 for transporting a cylindrical tank 12 is shown in FIGS. 1-5. Device 10 is comprised of a substantially circular collar 14 having an inner face 16 and an outer face 18. Collar 14 is generally made of steel or other strong, durable material. The diameter of the circular opening defined by inner face 16 is greater than the outer diameter of the cylindrical tank about which the collar is to be placed. Since cylindrical tanks of the kind used to store oxygen and acetylene are generally made in standard sizes, a standard collar can be made for each size tank.

Opposing, substantially parallel flanges 20, 22 are mounted on face 18 of collar 14. An aperture 24 through collar 14 is located between flanges 20, 22. Flanges 20, 22 are respectively provided with opposing, substantially parallel limit slots 26, 28.

Three frictional gripping teeth 30, 32, 34 are disposed substantially equidistantly from each other on the inner face 16 of collar 14. The teeth 30, 32 are welded or otherwise adhered to inner face 16. Each of teeth 30, 32, 34 is provided with an arcuate, roughened gripping face 36 (best seen in FIG. 3), face 36 being configured to frictionally grip the exterior of tank 12 when collar 14 is in place about tank 12. Teeth 30, 32 are stationary while tooth 34 is movable and provided with a projection 38 through aperture 24 in collar 14 (See FIG. 1).

A limit pin 40 is mounted on projection 38 for placement between and within opposing limit slots 26, 28 to provide reciprocal movement of tooth 34 from a first position in frictionally gripping engagement with the exterior of tank 12 around which collar 14 is placed to a second position not in frictionally gripping engagement therewith. As can best be seen in FIG. 4, the phantom lines show tooth 34 in the first position whereas the placement of tooth 34 in the second position is shown in dark lines.

A pivot pin 42 is carried between flanges 20, 22 and held in place by, for example, nuts on the outside faces of flanges 20, 22 which threadably engage with threads around the exterior of pivot pin 42.

Pistol grip handle 44 is pivotally mounted on pivot pin 42. Handle 44 is configured to present a flat edge 46, an enlarged portion 48 and a depending handle portion 50. Pivot pin 42 is placed adjacent limit slots 26, 28 such that the pivoting of handle 44 about pivot pin 42 forces edge 46 against limit pin 40 to advance tooth 34 from the position shown in dark lines in FIG. 4 to the position shown in phantom in FIG. 4. The movement of tooth 34 thereby brings it into frictionally gripping engagement with tank 12, and likewise pushes tank 12 into frictionally gripping engagement with stationary teeth 30, 32.

Handle 44 is provided with an elongated opening 52 through handle portion 50 and a substantially circular opening 54 in enlarged portion 48 of handle 44. Opening 52 is adapted for placement of the fingers of the hand therethrough, while opening 54 is configured to present an opening suitable for placement of a hook therethrough.

In operation, a person desiring to move a tank places collar 14 around the tank and grasps handle 44 by placing the fingers of his hand through opening 52. Tank 12 is then tipped forward, and the weight of the tank, as it moves away from its stationary position, creates a torque and forces handle 44 to pivot about pivot pin 42. The pivoting of handle 44 moves it from the position shown in dark lines in FIG. 4 to the position shown in phantom in FIG. 4. This pivoting of handle 44 causes edge 46 of handle 44 to incline toward limit pin 40 and push limit pin 40, within limit slots 26, 28, toward collar 14 in the direction of the arrows in FIG. 4. Movement of tooth 34 into the interior of the collar brings tooth 34 into frictionally gripping engagement with tank 12. At the same time, the forward motion of tooth 34 pushes tank 12 into firmly frictionally gripping engagement with teeth 30, 32 which are placed at stationary positions on inner face 16 of collar 14. The person desiring to move the tank can then convey it from place to place by disposing the tank in a somewhat horizontal position and carrying it to the desired location. Once tank 12 has reached that desired position, it is once again vertically oriented, and once the gravitational force of the tank is no longer exerted on the pivot handle, the pivot handle falls back to the position shown in dark lines in FIG. 4. Tooth 34 easily moves out of frictionally gripping engagement with tank 12, and collar 14 can readily be removed by lifting it over the head of tank 12.

Alternately, it may be desirable to move tank 12 with a crane or other large machinery. In such a situation, the crane cable is provided with a hook at the terminus thereof. This hook is disposed through circular opening 54, an upward force is exerted by the crane on the cable, which imparts a torque to handle 44 about pivot pin 42. In this fashion, edge 46 inclines towards pivot pin 40 and advances tooth 34 from its non-frictionally gripping position to its frictionally gripping position. Tooth 34 is maintained in its frictionally gripping position by the upward force being exerted by the crane as tank 12 is being transported. Once tank 12 is transported to its desired destination, the upward force on the crane cable is discontinued, and handle 44 falls back to the position shown in dark lines in FIG. 4. Collar 14 can then be readily removed over the head of tank 12 and used again.

I claim:

1. A carrying device for transporting an elongated cylindrical tank having a longitudinal axis from its top to its bottom, the device comprising:

a substantially circular collar having an inner face and an outer face, the diameter of circular opening defined by said inner face being greater than the outer diameter of said cylindrical tank;

a plurality of frictional grippers, disposed on the inner face of said collar, each gripper having an arcuate face having a plurality of rows of gripping teeth, the rows extending substantially perpendicularly to the direction of the longitudinal axis of the tank to be carried by the collar, one of said grippers being mobile from a first position in frictionally gripping engagement with the exterior of the tank on which the collar is placed to a second position not in frictionally gripping engagement therewith;

said mobile gripper being provided with a gripping tooth adapted to be moved from a first position in frictionally gripping engagement with the exterior of the tank and a second position not in frictionally gripping engagement therewith;

wherein said mobile gripper is further provided with a means for moving said tooth from said second position to said first position, said means for moving said gripping tooth from said second position to said first position comprising:

a projection on said tooth for placement through an aperture in said collar;

a limit pin carried by said projection;

first and second opposing, substantially parallel flanges, one on each side of said aperture, each of said flanges being provided with a limit slot for cooperatively guiding the limit pin of said projection;

a pivot pin between said flanges; and a pivotal handle mounted in pivoting engagement on said pivot pin, the pivoting of said handle abutting said limit pin and moving said limit pin within said limit slots to move said gripping tooth from said second to said first position.

2. The carrying device of claim 1, wherein said handle is a pistol grip handle provided with an elongated opening through which the fingers of a hand may be placed and a substantially circular hook receiving opening through which a hook may be placed, the pistol grip handle projecting downwardly past the collar in a direction towards the bottom of a tank being carried when the device is in use, the elongated opening being of sufficient length and width to accommodate all the fingers of a hand.

3. The carrying device of claim 2, wherein there are three grippers, two of said grippers being stationary and the third being movable from said second to said first position, each of said grippers being disposed about 120° apart from each adjacent gripper.

4. A carrying device for transporting a cylindrical tank, comprising:

a substantially circular collar having parallel inner and outer faces, the diameter of the circular opening defined by said inner face being greater than the outer diameter of said cylindrical tank, the collar having a top edge and a bottom edge, the top edge being closer to the top of the tank when the device is in use, the bottom edge being closer to the bottom of the tank when the device is in use;

a pair of opposing, substantially parallel flanges mounted on the outside face of said collar, one flange on either side of an opening through the collar, each flange defining an elongated limit slot which is elongated in a direction perpendicular to the faces of the collar, said limit slots being opposing and substantially parallel;

three frictional gripping teeth disposed substantially equidistantly from each other on the inner face of said collar, each of said teeth being provided with an arcuate, roughened gripping face configured to frictionally grip the exterior of said tank, two of said teeth being stationary, the third being movable and provided with a projection through said aperture in the collar, each gripper face having a plurality of rows of gripping teeth, the rows extending substantially perpendicularly to the direction of the longitudinal axis of the tank to be carried by the collar;

a limit pin mounted on said projection for placement in sliding relationship between and within said opposing limit slots to provide reciprocal movement of said third gripping tooth from a first position in frictionally gripping engagement with the exterior of the tank around which the collar is placed to a second position not in frictionally gripping engagement therewith, the diameter of the pin being substantially equal to the width of the limit slots through the opposing flanges;

a pivot pin carried between said flanges adjacent said limit slots; and a downwardly depending pistol grip handle pivotally mounted on said pivot pin such that the pivoting of said handle on said pivot pin inclines said handle against said limit pin and moves said third gripping tooth from said second position to said first position, the pistol grip handle projecting downwardly past the collar in a direction towards the bottom of the tank being carried when the tank is in use, the handle being provided with an elongated opening of sufficient width to accommodate all the fingers of a hand.

5. The carrying device of claim 4 wherein said pistol grip handle is provided with an elongated opening through which fingers of a hand may be placed and a substantially circular opening through which a hook may be placed.

* * * * *